US005289781A

United States Patent [19]

Beckway

[11] Patent Number: 5,289,781

[45] Date of Patent: Mar. 1, 1994

[54] CORRUGATED PALLET LEG AND METHOD

[75] Inventor: Bruce C. Beckway, River Forest, Ill.

[73] Assignee: Packing Materials Corporation, Chicago, Ill.

[21] Appl. No.: 995,681

[22] Filed: Dec. 23, 1992

[51] Int. Cl.[5] ..... B65D 19/00

[52] U.S. Cl. ..... 108/51.3; 108/56.3; 156/294

[58] Field of Search ..... 108/56.3, 51.3, 56.1; 156/294, 293

[56] References Cited

U.S. PATENT DOCUMENTS

| | | | |
|---|---|---|---|
| 3,055,624 | 9/1962 | Wilson | 108/51.3 |
| 3,407,758 | 10/1968 | Simkins | 108/51.3 |
| 3,995,736 | 12/1976 | Lawson et al. | 108/51.3 |
| 4,228,744 | 10/1980 | Moore | 108/51.3 |
| 4,244,766 | 1/1981 | Yellen | 108/51.3 |
| 4,390,154 | 6/1983 | Ostler et al. | 108/51.3 |
| 4,487,136 | 12/1984 | Beckway | 108/51.3 |
| 4,697,699 | 10/1987 | Schneider | 108/51.3 |
| 4,850,284 | 6/1989 | DeGrodt et al. | 108/51.3 |
| 4,966,084 | 10/1990 | Motomaru | 108/51.3 |
| 5,195,440 | 3/1993 | Gottlieb | 108/51.3 |

*Primary Examiner*—Peter M. Cuomo
*Assistant Examiner*—Michael J. Milano
*Attorney, Agent, or Firm*—Basil E. Demeur; Alan B. Samlan

[57] ABSTRACT

There is disclosed an improved corrugated pallet having pallet legs attached at various points of attachment. The field of invention relates to a corrugated cardboard pallet of the type generally formed by a pair or more of pallet decks which are stacked atop one another, each of which has finger elements die cut therein radiating outwardly from a central circle and terminating on a circular score line of substantially the same diameter as the inner diameter of one of the leg elements. The die cut lines for the fingers radiate tangentially outwardly to create a substantially spiral pattern. The leg assembly is of the type formed by an outer leg, and an inner leg, with the radiating die cut fingers nested between the annulus created between the outer and inner leg and adhesively secured to the legs. The improvement consists of die cutting a series of linearly aligned perforations along the length of each finger, such that when the adhesive is applied to the outer and inner surfaces of the fingers, the adhesive is permitted to permeate the inner confines of the corrugated material forming the fingers thereby increasing the surface area of adhesive for securing the finger elements to the respective leg elements.

8 Claims, 4 Drawing Sheets

CORRUGATED PALLET LEG AND METHOD

BACKGROUND OF THE INVENTION

The present invention relates to corrugated pallets and in particular to the type of corrugated pallets which have been developed for the purpose of providing inexpensive and light weight pallets constructed of corrugated cardboard.

Pallets are of course widely utilized in all industries for the purpose of stacking and transporting various goods. It is well-known that in the past, pallets were formed of wood, in order to lend rigidity and strength to the pallet so that merchandise of great weight could be stacked and transported on the pallets. However, with the advent of conservation, and preservation of the natural resources, the use of woods for constructing pallets has been deemed to be undesirable, and even more important, it has now been determined by many countries in the world that wood is a nesting place for various types of bacteria and other undesirable germs, especially when the wood is wet or rotted. Just as importantly, it has been found in many countries that pest infestation has become a widespread problem, and it has been found that wood pallets have a tendency to introduce unwanted pests in different countries. Hence, in many countries of the world, wood pallets are not even permitted into the country unless they have been properly fumigated. This has caused a tremendous cost impact on those entities employing wood pallets for the purpose of shipping goods from place to place. The net result is that there has developed a strong tendency toward pallets constructed of alternate material.

In this connection, the art has gravitated to corrugated pallets which are made of corrugated paper and other materials which are relatively inexpensive, are capable of bearing weight, and are totally recyclable. Applicant has patented a certain pallet leg for a corrugated cardboard pallet under U.S. Pat. No. 4,487,136 which discloses and claims a corrugated pallet having leg elements which are installed onto the pallet deck, which yields a corrugated pallet having sufficient strength for virtually all applications in connection with the stacking and transport of goods placed thereon. Assignee's later U.S. Pat. No. 4,850,284 has further disclosed an improvement which relates to the cross-laminating of the cardboard pallet decks in order to further enhance the rigidity and strength of the subject pallet.

In both instances, the method of attaching the pallet leg to the pallet is by die cutting a plurality of finger members in a tangentially radiating manner in order to create a substantially spiral pattern with the fingers. The core legs are installed onto the pallet deck by twisting an inner leg in the direction of the spiral pattern of the finger elements, and nesting the inner leg within an outer leg having the fingers interposed in the annulus formed there between. Attachment is achieved by means of the use of an adhesive which is applied to the finger elements such that once the finger elements are nested within the annulus formed between the inner and outer leg elements, the cores forming the leg elements will become adhesively secured to the pallet deck via the finger elements.

It will be appreciated from the above description, that the method of attachment relates to the positioning of an adhesive such as a glue, on the outer as well as inner surfaces of the finger elements such that when the finger elements are interposed or nested within the annulus formed between the outer and inner leg elements, the finger elements will become adhesively secured on both surfaces to the respective core leg elements. It has been observed, however, that when the adhesive is applied in this manner, the adhesive merely spreads over the skin or surface of the outer surface and inner surface of the finger elements. Hence, the ability to secure the core legs to the deck is strictly a function of the securement which is achieved by the adhesive being interposed between the surface of the finger elements and the respective inner or outer leg element. While this has produced a pallet which has a high degree of strength and rigidity, and permits a great degree of weight to be stacked onto the pallet, and also provides a pallet having legs which are securely attached thereto, it has now been determined that the securement of the pallet legs to the pallet may be further enhanced by virtue of the present invention. Hence, the present invention is intended as a method of further enhancing the securement of the pallet legs to the pallet deck in order to further strengthen the pallet as a whole, and especially, to enhance the strength of the attachment or securement of the legs to the pallet deck. This feature has an impact since these pallets are utilized in connection with forklift vehicles which are employed for lifting and transporting the pallets from place to place. The use of such forklift vehicles is widespread and common knowledge, however, it is also known that the use of these types of vehicles, will often cause damage to the pallets where the tynes of the forklift strike the pallet legs when the operator attempts to position the forklift vehicle in a proper position to lift the pallet for transportation purposes. Hence, it is believed that the present invention, by providing a greater bond between the leg elements and the pallet deck, enhances the value of the pallet and further reduces the possibility of damage which occurs by the use of forklift vehicles.

OBJECTS AND ADVANTAGES

It is therefore the principal object of the present invention to provide an improved corrugated pallet which incorporates therein a leg which is more securely attached to the pallet deck thereby to further increase the strength and shear resistance of the pallet to damage.

In connection with the foregoing object, it is a further object of the present invention to provide an improved corrugated pallet of the type wherein the core legs are attached to the pallet deck by means of die cutting a plurality of finger members in a spiral configuration such that the cores may be attached by twisting an inner core leg into an opening created by the die cut pattern of the finger elements and interposing the finger elements between the inner leg and an outer leg element, and by further die cutting into the finger elements a plurality of perforations linearly aligned such that an adhesive applied to the surfaces of the finger members incident to the securement procedure, will penetrate the inner confines of the finger elements and introduce adhesive into the corrugated inner structure of the finger elements such that when the adhesive dries, the core leg elements are more securely held onto the pallet deck.

In connection with the foregoing objects, a further object of the present invention is to provide a pallet leg and method of attachment of the leg to a pallet deck wherein a plurality of linearly aligned perforations are provided in each of the finger elements, such perforations being positioned within the confines of the finger elements in a manner spaced slightly outwardly from the circular score line which bears substantially the same diameter as the inner leg element, and terminating at a point spaced inwardly from the central circle such that the structural integrity of the finger elements is not destroyed.

Further features of the invention pertain to the particular arrangement of the parts and the method of operation, all of which is more fully disclosed in the specification set forth hereinafter, and specifically set forth in the claims.

SUMMARY OF THE INVENTION

In summary, the present invention provides an improved corrugated pallet wherein the pallet legs are more securely affixed to the pallet deck, and also provides a method for manufacturing such an improved pallet. The improvement resides in the recognition of the provision of a series of linearly aligned perforations extending along the length of each of the finger elements which are in turn, the securement means for securing the pallet leg elements to the pallet deck, such that an increase in the strength and shear resistance of the corrugated pallet legs is achieved. The perforations provide a means for the adhesive to penetrate and permeate the interior portions of the corrugated material forming the fingers thereby providing an improved adhesive base for adhesively securing the leg elements to the pallet deck. The method provides the additional step of die cutting into the finger elements, incident to die cutting the finger elements per se, a series of linearly aligned perforations penetrating the skin or surface of the corrugated pallet deck material, thereby to afford the adhesive an entry into the interior portion of the finger elements and spreading the adhesive such that the finger elements are more securely fastened to the leg elements.

DETAILED DESCRIPTION OF DRAWINGS

Figure 1:
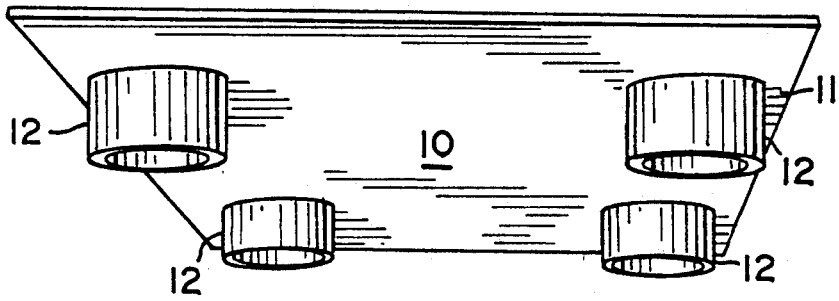
FIG. 1 is a perspective view showing a typical single pallet deck corrugated pallet having a series of four legs affixed thereto.

With reference to FIG. 1 of the drawings, there is shown a typical corrugated pallet 10 of the type generally represented in U.S. Pat. No. 4,487,136. This type of construction generally is formed from a pallet deck 11 to which a series of four legs 12 are secured. The method of securement of the pallet legs 12 to the pallet deck 11 is generally disclosed in U.S. Pat. No. 4,487,136. As indicated therein, the pallet deck 11 is die cut in each position where a pallet leg 12 is intended to be secured, by die cutting an opening consisting of a series of finger elements of a generally triangular configuration, having as their base a circular score line 14 (See FIG. 3), which defines a hinge point for each finger. The finger elements extend to an interior circle 16 as is understood, again, from the description set forth in U.S. Pat. No. 4,487,136. For purposes of the present description, each finger element shall be referred to by the numeral 20.

Figure 5:
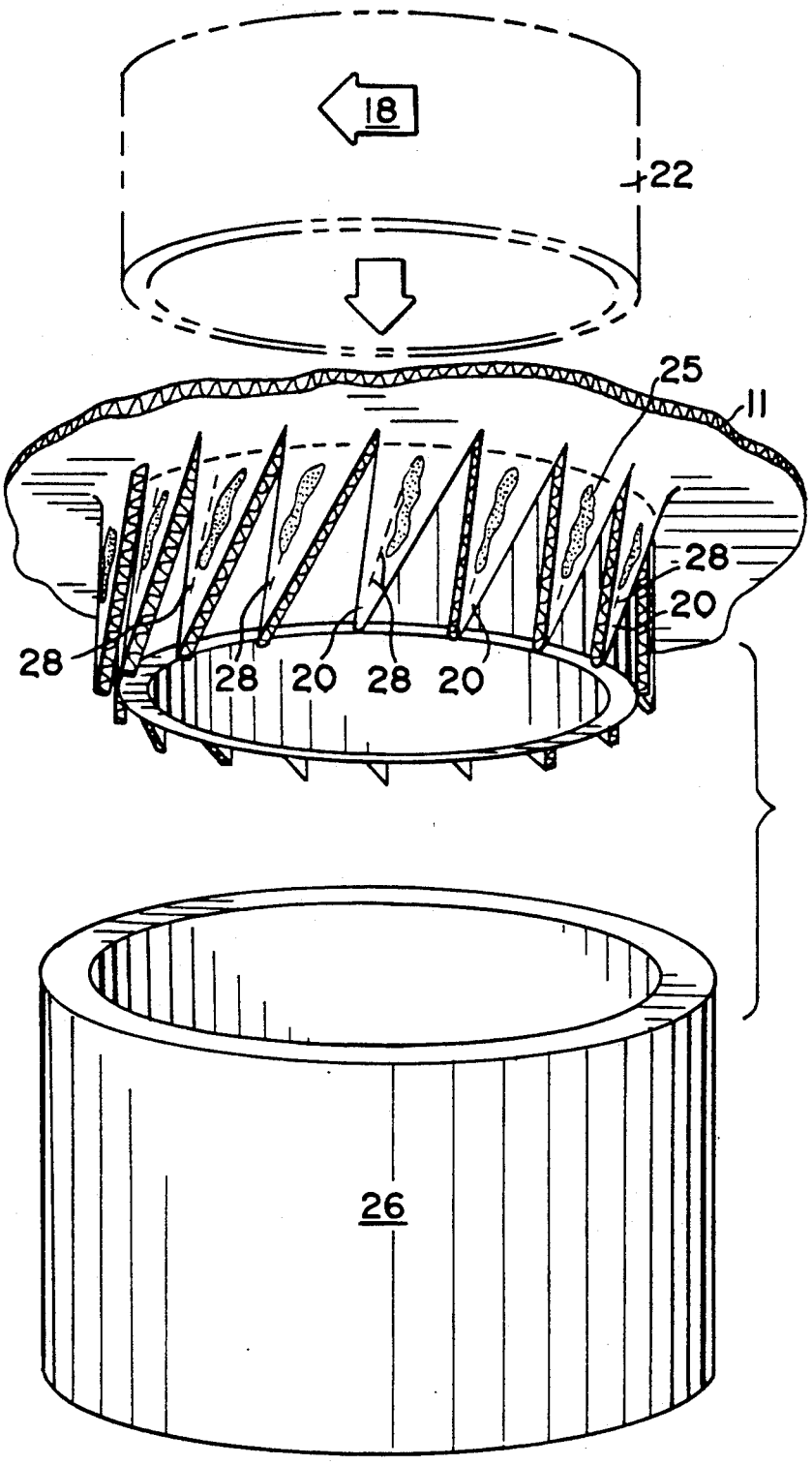
FIG. 5 is a front elevational, exploded view, showing the manner in which the inner and outer core leg elements are positioned within the pallet deck and further illustrating the perforations within the finger elements as a means for enhancing the adhesive dispersion.

In connection with the assembly of the pallet 10 as shown in FIG. 1, the pallet deck 11 is introduced into a die cutting machine, which will die cut the finger elements 20 in the positions required in order to insert the legs 12, whether there be four or more legs. Once the finger elements 20 are die cut, an inner leg member 22 is inserted downwardly through the circular score line 14 and twisted in the direction of the arrow as depicted in FIG. 5 of the drawings by the numeral 18. It will be appreciated that adhesive is first applied to the inner surface 21 of the fingers 20 (FIG. 3) prior to the insertion of the inner leg member therein, such that once the inner leg member 22 is pressed downwardly therethrough, the adhesive (not shown) will spread over the surface skin of the finger element 20 and come into touching contact with inner leg member 22.

As indicated in both U.S. Pat. Nos. 4,487,136 and 4,850,284, adhesive 25 (FIG. 5) is also applied to the outer surface of the finger element 20, such that when the outer leg member 26 is positioned on the outer surface of each finger element 20, the adhesive will expand and cover the outer surfaces of finger elements 20 relative to the interior side wall of the outer leg member 26.

As described and shown, the corrugated pallet 10 will therefore consist of a pallet deck 11 which has a plurality, such as four or more, leg members secured thereto, by means of a plurality of die-cut finger elements 20 which are die cut in a substantially tangential manner in order to create a substantially spiral pattern.

Figure 6:
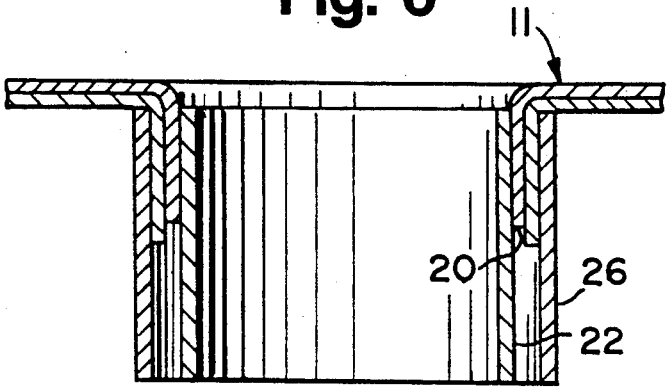
FIG. 6 is a side elevational view, in cross-section, showing a completed pallet with the core leg elements attached.

As has been indicated in the past, the spiral pattern is important to the integrity of the pallet for the reason that when the inner leg member 22 is inserted and pressed downwardly to nest within the outer leg member 26, it is rotated in the manner indicated in FIG. 5, and this rotational movement will fix the finger elements 20 in a nesting position in the annulus created between the inner and outer leg elements as depicted in FIG. 6 of the drawings. As has been indicated in the past, when the finger elements 20 are cut in a sunburst pattern as is known in the prior art, and not in a spiral pattern as indicated herein, the downward insertion of the inner leg member relative to the outer leg member has a tendency to cause a tearing of the finger elements thereby weakening the pallet structure. Hence, both U.S. Pat Nos. 4,487,136 as well as 4,850,284 have described a corrugated pallet which has far superior strength capabilities in terms of not only load bearing, but also in terms of resistance to shearing from the use of forklift vehicles.

Figure 2:
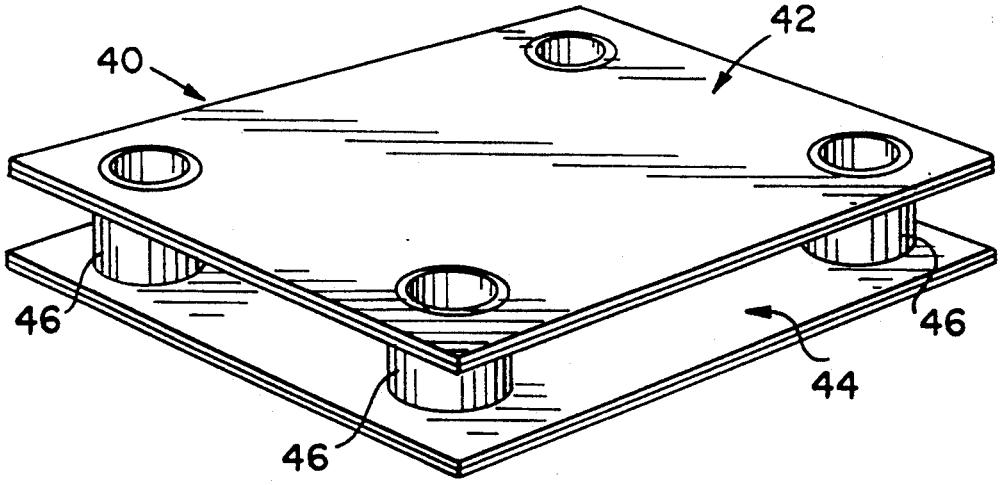
FIG. 2 is a perspective view showing a typical double deck corrugated pallet having a series of four legs securing the pallet decks as a completed assembly.

FIG. 2 is merely intended to illustrate still another version of a corrugated pallet which is intended to be within the scope of the present invention. The pallet illustrated in FIG. 2 is generally represented by the numeral 40, and is generally referred to as a double deck pallet. The double deck pallet includes an upper deck 42 and a lower deck 44 which are maintained in spaced apart secured position by means of a plurality of leg members 46. It is contemplated by the present invention that regardless of whether one constructs a pallet in accordance with FIG. 1 consisting of a single deck pallet, or a pallet constructed in accordance with FIG. 2 consisting of a double deck pallet, the method of the present invention, and the resulting product, applies.

Figure 3:
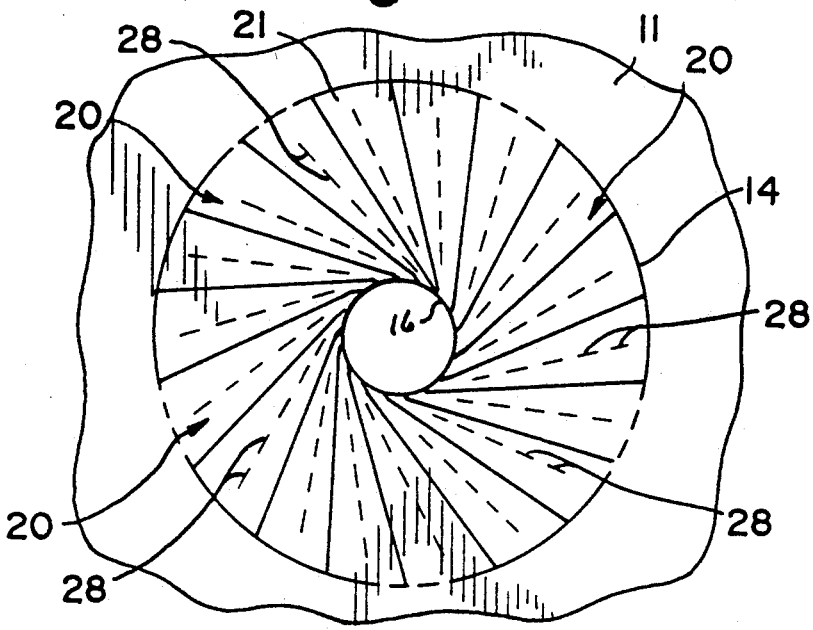
FIG. 3 is a top perspective view showing the finger elements and perforations die cut into the surface of a pallet deck.
Figure 4:
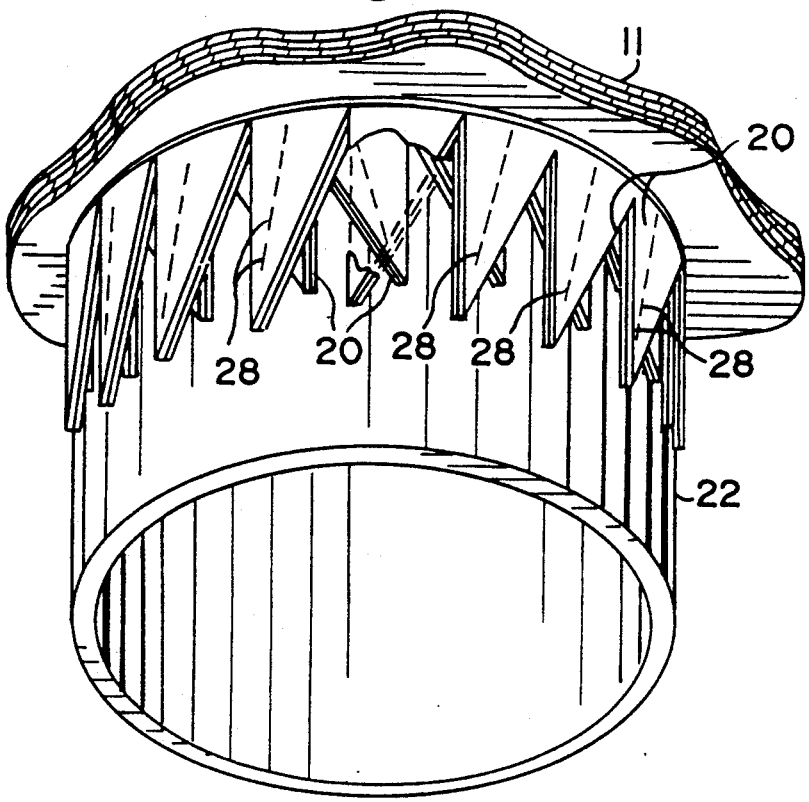
FIG. 4 is a perspective, front elevational view, partly broken away, showing the manner in which a double pallet deck is die cut including perforations die cut into the finger elements to enhance the spread of the adhesive incident to the manufacturing process.
Figure 7:
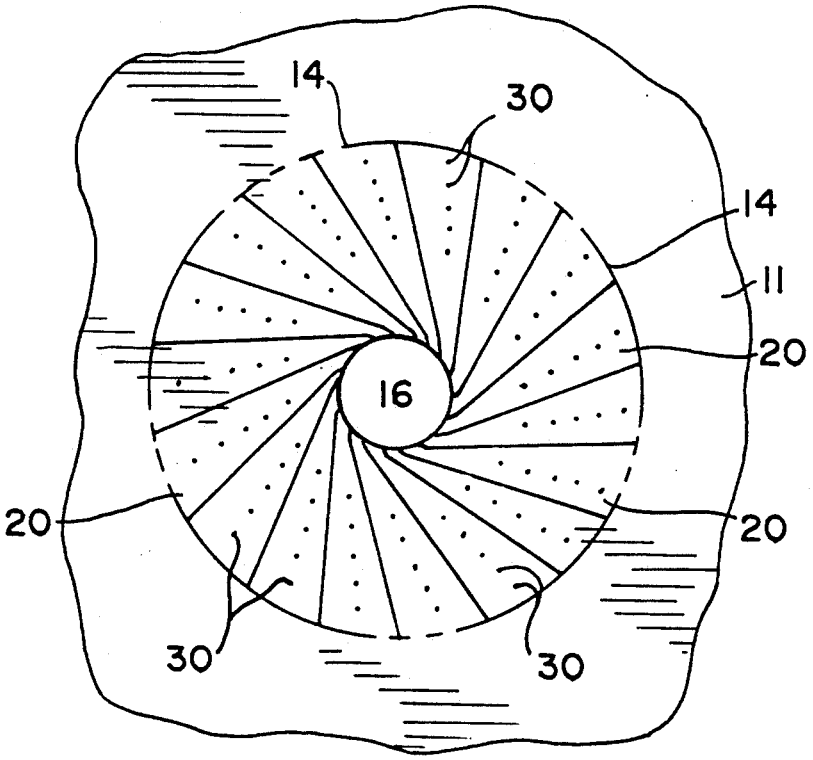
FIG. 7 is a top plan view showing the die cut of the finger elements including an alternate embodiment of the perforations formed in each of the finger elements, linearly aligned and designed to enhance the adhesive dispersion.

As more specifically shown in FIGS. 3, 4, and 7 of the drawings, the present invention contemplates a plurality of finger elements 20 which, when die cut in the manner indicated, are further die cut in a manner to include a series of perforations 28 (See FIG. 3) which extend linearly along the length of each of the finger elements 20. The perforations 28 (FIG. 3) once die cut, penetrate the surface skin of the finger elements 20, and therefore allow access to the interior confines of the corrugated forming the material of the deck 11. As depicted in FIG. 3 of the drawings, the perforations may assume the configuration of elongated slots, and extend along the linear length of each finger element 20. However, it is important that the perforations be spaced both from the circular score line 14, as well as spaced inwardly from the interior circle 16 (See FIG. 3) in order to maintain the structural integrity of the corrugated material. It will be apparent from viewing FIG. 3 of the drawings that the finger elements 20 are in the form of a triangular configuration with the point of the triangle adjacent to the interior circle 16. It is therefore important that the perforations not extend all the way to the interior circle 16, but rather, be spaced inwardly therefrom. Furthermore, since the finger elements 20 extend from the circular score line 14, again, it is important that the perforations begin at a point spaced outwardly and away from the score line 14. It is preferable that perforations 28 be spaced at least 0.25 inches from the circular score line 14, and terminate at a distance not greater than 0.5 inches from the interior circle 16. These distances represent an anticipated safe margin for insuring that the structural integrity of each of the finger elements 20 is not destroyed incident to the manufacturing process.

As depicted in FIG. 4 of the drawings, where the corrugated pallet is constructed by having an upper double deck wherein there are cross-laminated layers of corrugated forming the upper deck 11, each of the upper decks will be die cut to create a plurality of finger members 20. As depicted therein, when the finger elements 20 of the upper deck are die cut and the finger elements 20 of the lower deck are die cut, a cross-pattern is achieved such that the respective finger elements 20 overlie one another but in a crisscross pattern. This construction has been explained in U.S. Pat. No. 4,850,284. It will be appreciated from a view of FIG. 4 of the drawings, that the method of the present invention may similarly be employed in that perforations 28 are die cut into all of the finger elements 20 such that when the adhesive is applied as generally depicted in FIG. 5, the adhesive will be allowed to permeate both finger elements 20 from each of the multiple decks forming the corrugated pallet 10 or 40.

An alternate embodiment of the present invention is depicted in FIG. 7 of the drawings. In this embodiment, the perforations are in the form of a series of circular perforations 30, and are shown to be, once again, linearly aligned along the length of each finger element 20. Once again, it is important that the spacing requirements indicated hereinabove be maintained in that the perforations 30 should be spaced approximately not less than 0.25 inches from the circular score line 14, and should terminate not more than approximately 0.5 inches from the interior circle 16. Again, it is important to maintain the structural integrity of the finger elements 20 and it is therefore deemed desirable not to extend the perforations 30 or elongated slots 28, to the very tip ends of the finger elements 20 adjacent to the interior circle 16. It is believed that such a construction would weaken the tip ends of the finger elements 20 and take away from the structural integrity of the pallet assembly as a whole.

It will be appreciated from a view of FIG. 4 of the drawings, that where a corrugated pallet having an upper double deck is constructed, each of the finger elements 20 would be perforated with perforations 28 as illustrated therein, and hence, when adhesive is applied to each of the fingers, the adhesive is permitted to permeate and enter into the interior confines of the corrugated material such that upon setting, both the inner leg member 22 as well as outer leg member 20 will have a greater adhesive base for securement to the fingers 20 generally, and hence, the pallet 10 as a whole.

Present research indicates that when a corrugated pallet having a core leg assembly in the manner indicated herein is affixed to the pallet deck in the manner set forth herein, but further including the perforated finger elements, the securement of the legs to the deck is strengthened by a factor of anywhere between fifteen (15%) and forty (40%) percent greater than the securement of legs heretofore achieved with corrugated pallets constructed in accordance with present techniques.

It is further contemplated that it is possible to perforate each of the finger elements in a wide variety of patterns, or indeed, to create perforations in double or triple rows extending down the length of each finger element. It is contemplated that the criticality in any such perforating of the finger elements requires that the structural integrity of the finger elements be maintained such that during the manufacturing procedure for insertion of the legs into the deck material in order to create the pallet, the fingers maintain their structural integrity and not be subject to shearing or tearing. It is apparent that perforations do tear the surface and skin of the corrugated, and hence, it is believed that the greater the number of perforations, the greater the integrity of the finger is violated. Hence, it is believed that there is a requirement that there be a balance between the number of perforations, and the maintenance of structural integrity. A perforated pattern in accordance with the description set forth herein has been found to increase the strength and securement of the pallet legs to the pallet deck thereby creating a corrugated pallet having yet superior strength and shear resistant qualities.

While there has been described what is at present considered to be the preferred embodiments of the invention, it will be understood that further modifications may be made therein, and is intended to cover in the appended claims all such modifications as fall within the true spirit and scope of the invention.

I claim:

1. In a pallet of the type formed by a pallet deck having a plurality of tubular legs attached thereto, wherein each of the tubular legs is formed from an inner leg and an outer leg element, and wherein the pallet deck is formed of at least two pallet deck members of corrugated cardboard stacked together atop one another and each of the pallet deck members at each leg attachment point having a plurality of finger elements formed of die-cut lines radiating outwardly from a central circle and terminating on a circular score line of substantially the same diameter as the inner diameter of an outer leg element, the finger elements being die cut in the respective ones of the pallet deck members, the inner and outer leg members being proportioned to nest within one another and to retain the finger elements die cut in both pallet deck members within the annulus formed between the nested inner and outer leg elements, and wherein the tubular legs are secured to the pallet deck and the pallet deck members are secured together one atop the other by placing an outer leg element under the stack pallet deck members and aligned with the circular score line, the inner leg element atop the stack deck members and aligned with the circular score line, applying an adhesive on the finger elements and pressing the inner leg element through the pallet deck members into the outer leg element with the finger elements being captured in overlapping relationship between the outer and inner leg elements, and spreading the adhesive therebetween, the improvement comprising, each of said finger elements die cut in each of said pallet deck members being provided with a series of linearly aligned perforations die cut therein and extending from a point spaced slightly inwardly from said circular score line having substantially the same diameter as the inner leg element, and terminating at a point spaced inwardly from the central circle, said perforations allowing the adhesive applied to said finger elements to permeate said finger elements thereby to increase the surface area of the adhesive relative to the finger elements, which secures said leg elements to said fingers, whereby the resulting strength of said leg elements relative to said pallet deck is increased by a factor of between ten (10%) percent and forty (40%) percent.

2. The improved corrugated pallet as set forth in claim 1 above, wherein said perforations are formed as elongated slots linearly aligned along the length of said finger elements.

3. The improved corrugated pallet as set forth in claim 1 above, wherein said perforations are formed as circular holes linearly aligned along the length of said finger elements.

4. The improved corrugated pallet as set forth in claim 1 above, wherein said perforations extend from a point not less than 0.25 inches from said circular score line and terminating at a point not greater than 0.5 inches from the central circle.

5. In a method of manufacturing a pallet which includes the steps of forming a pallet deck of at least two corrugated cardboard pallet deck members stacked together atop one another, and die cutting in each of the pallet deck members at each leg attachment point a plurality of finger elements formed of die-cut lines spirally radiating outwardly from a central circle and terminating on a circular score line, providing a plurality of pallet legs, each of which is formed of inner and outer leg elements being proportioned to nest within one another and to retain the finger elements die cut in both pallet deck members at a leg attachment point in overlapped relationship with the annulus formed between the nested outer and inner leg elements, applying an adhesive on the surfaces of each finger element, and wherein a further step is provided by securing the pallet deck members together and the pallet legs to the pallet by placing an outer leg element under the stack pallet deck member and aligned with the circular score line, an inner leg element atop the stack deck members and aligned with the circular score line, and forcibly inserting the inner leg element into the outer leg element with the finger elements being captured between the outer and inner leg elements by pressing the inner leg element through the stack pallet deck members into the outer leg element, thereby to spread the adhesive and allow the finger elements to adhesively secure to the leg elements, the improvement comprising, die cutting a series of linearly aligned perforations extending from a point spaced slightly inwardly from the circular score line, and terminating at a point spaced inwardly from the central circle, and allowing the adhesive applied to secure the finger elements to the respective inner and outer leg elements to permeate the inner confines of the corrugated pallet deck members, whereby the resulting corrugated pallet manufactured in accordance with the above method increases the relative strength of the attachment of the leg elements to the pallet deck by a factor of between ten (10%) percent and forty (40%) percent.

6. The method as set forth in claim 5 above, wherein the perforations die cut into each of said finger elements assumes the configuration of elongated slots linearly aligned along the length of each finger element.

7. The method as set forth in claim 5 above, Wherein the perforations die cut into each of said finger elements assumes the configuration of a plurality of circular holes die cut in each of said finger elements and linearly aligned therein.

8. The method as set forth in claim 5 above, wherein said perforations die cut into each of said finger elements extends from a point spaced inwardly from the circular score line at least a distance of 0.25 inches, and terminates at a point spaced inwardly from the central circle by a distance of not greater than 0.5 inches.

* * * * *